US006036629A

United States Patent [19]

Rea et al.

[11] Patent Number: 6,036,629

[45] Date of Patent: Mar. 14, 2000

[54] CYLINDRICAL COMPOSITE CONTAINER HAVING A RECESSED SPIRAL GROOVE AND PROCESS FOR MANUFACTURING

[75] Inventors: Keith Rea, Florence; Mark Morrow, Camden; James Lowry, Florence, all of S.C.

[73] Assignee: Sonoco Development, Inc., Hartsville, S.C.

[21] Appl. No.: 09/175,797

[22] Filed: Oct. 20, 1998

[51] Int. Cl.[7] ..... B31C 1/00

[52] U.S. Cl. ..... 493/299; 493/301; 493/303; 493/304

[58] Field of Search ..... 493/299, 303, 493/304, 305, 301, 269, 288

[56] References Cited

U.S. PATENT DOCUMENTS

| | | | |
|---|---|---|---|
| D. 70,765 | 8/1926 | Jones . | |
| D. 386,401 | 11/1997 | Prestia et al. . | |
| 3,301,734 | 1/1967 | Britton et al. | 493/299 |
| 3,533,883 | 10/1970 | Gartaganis et al. . | |
| 3,548,724 | 12/1970 | Hall | 493/299 |
| 4,629,529 | 12/1986 | Kadunce | 493/299 |
| 5,370,250 | 12/1994 | Gilbert . | |
| 5,556,365 | 9/1996 | Drummond et al. | 493/299 |
| 5,586,963 | 12/1996 | Lennon et al. | 493/299 |
| 5,704,504 | 1/1998 | Bueno . | |
| 5,857,613 | 1/1999 | Drummond et al. | 493/299 |
| 5,873,806 | 2/1999 | Biagiotti | 493/299 |

*Primary Examiner*—Eugene L. Kim
*Attorney, Agent, or Firm*—Alston & Bird LLP

[57] ABSTRACT

A process for manufacturing and the resulting cylindrical composite container having a recessed spiral groove therein includes generally the following. A mandrel is provided having at least one recessed spiral groove cut into its surface and positioned at a predetermined angle to a longitudinal axis of the mandrel. Desired material layers for constructing the composite container are fed onto the mandrel and are spirally-wound at a winding angle corresponding to the predetermined angle of the spiral groove in the mandrel to form a continuous tube on the mandrel. Pressure is applied at the mandrel spiral groove to the continuous tube as it is being formed to force the material layers into the spiral groove for deforming the material layers to form a spiral groove in the continuous tube. This continuous tube with a spiral groove therein is cut into individual continuous lengths and removed from the mandrel for forming the composite container.

7 Claims, 2 Drawing Sheets

CYLINDRICAL COMPOSITE CONTAINER HAVING A RECESSED SPIRAL GROOVE AND PROCESS FOR MANUFACTURING

FIELD OF THE INVENTION

This invention relates to a process for manufacturing a cylindrical composite container having a recessed spiral groove therein and to the composite container so manufactured.

BACKGROUND AND SUMMARY OF THE INVENTION

Composite containers are utilized for packaging a variety of products including food products, powdered products, etc. There is always a need to improve such composite containers, particularly from the standpoint of product differentiation, packaged product protection and ergonomics.

It has been determined by this invention that a composite container of this general type could be improved by providing such composite container with a recessed spiral groove extending around the container for the length of the container. The benefits of such a container construction would be generally, as follows.

Firstly, a spiral groove in such a composite container would be ascetically different from current composite container designs or constructions. This geometric design feature would warrant the attention of consumers to a greater extent than just graphics placed on such a composite container. Secondly, the geometry of a recessed spiral groove in such a composite container would provide greater resistance to rupture and better cushioning from side impact of a filled container. Side impact on a composite container without such inwardly grooved construction can cause a rupture in the container wall. A rupture could naturally contaminate the product, cause the product to spoil or even cause the product to spill. Very fragile items could also receive greater protection from the cushioning or dampening effect of the recessed grooves over a conventional straight walled container. Another benefit of a composite container with recessed spiral grooves is one of ergonomics. A composite container that has recessed grooves is easier to grasp and hold than a straight walled container. Larger diameter containers can be handled much easier and safer with the presence of recessed spiral grooves.

In accordance with this invention, it has been determined that such an improved composite container could preferably comprise at least one spirally-wound paperboard bodywall layer in strip form defining a substantially cylindrical container having opposed ends, a liner layer in strip form spirally-wound inside the bodywall layer in superimposed position therewith, and at least one recessed spiral groove formed in the superimposed bodywall layer and liner layer and extending around the cylindrical container along its length and being positioned at an angle to a longitudinal axis of the container which corresponds to a winding angle of the spirally-wound container. It has also been found desirable to incorporate a plurality of closely-spaced spiral grooves positioned at an angle to the longitudinal axis of the container for forming a spaced group of spiral grooves around the cylindrical container along its length. The container may further comprise a label layer in strip form spirally-wound around the outside of the bodywall layer in superimposed position therewith and having the recessed spiral groove formed therein.

This novel composite container construction has not heretofore been thought possible or practical from a manufacturing standpoint inasmuch as current spiral winding equipment for such composite containers does not allow for inward grooves in the bodywall of the composite container due to the solid geometry of the mandril used therein and the process requirement that the material being spirally-wound must spiral down the mandrel as the container is being made. Accordingly, in accordance with this invention, a process for manufacturing a cylindrical composite container having a recessed spiral groove therein has been developed and comprises generally the following steps.

A mandrel is provided which has at least one recessed spiral groove cut into its surface and positioned at a predetermined angle to a longitudinal axis of the mandrel. Desired layers of material for constructing the composite container are provided and are fed onto the mandrel while spirally winding such material layers at a winding angle corresponding to the predetermined angle of the spiral groove in the mandrel to form a continuous tube of the material layers on the mandrel. External pressure is applied at the mandrel spiral groove to the continuous tube as it is being formed to force the material layers into the spiral groove for deforming the material layers to form a spiral groove in the continuous tube. The continuous tube with spiral groove therein is then cut into individual container lengths and these container lengths are removed from the mandrel to form individual composite containers.

The mandrel may preferably include a plurality of closely-spaced spiral grooves positioned at a predetermined angle resulting in a spaced group of spiral tubes around the mandrel to form a spaced group of spiral grooves around the manufactured composite container.

BRIEF DESCRIPTION OF THE DRAWINGS

Some of the objects and advantages of the present invention have been set forth above, other objects and advantages will become clear from the following more detailed description of a preferred embodiment of this invention when taken in conjunction with the accompanying drawings, in which.

DETAILED DESCRIPTION OF PREFERRED EMBODIMENT OF THE INVENTION

Figure 1:
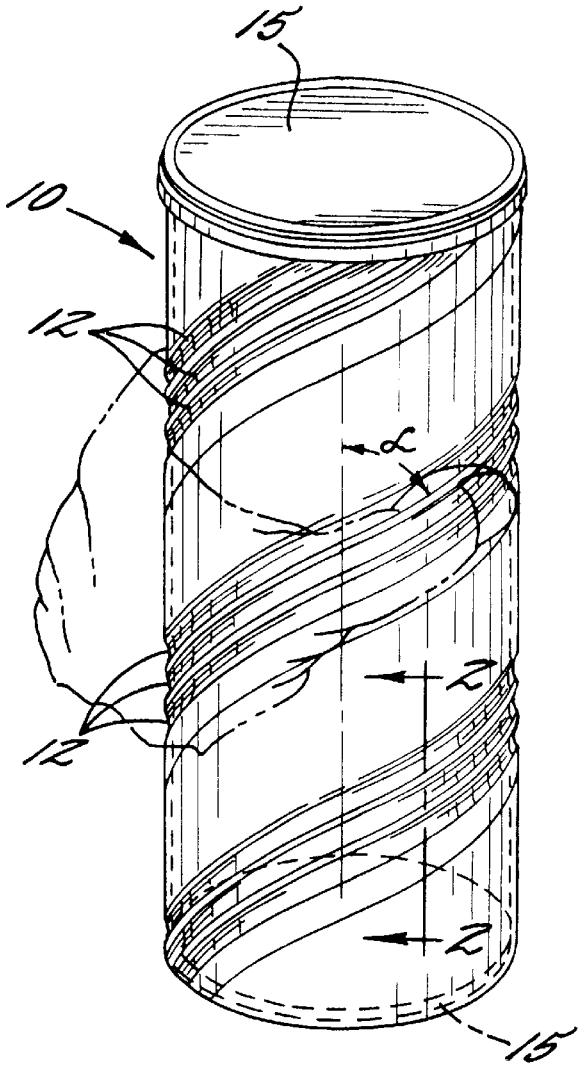
FIG. 1 is a perspective view of a cylindrical composite container having a recessed spiral groove therein and constructed in accordance with this invention and manufactured in accordance with the process of this invention.
Figure 2:
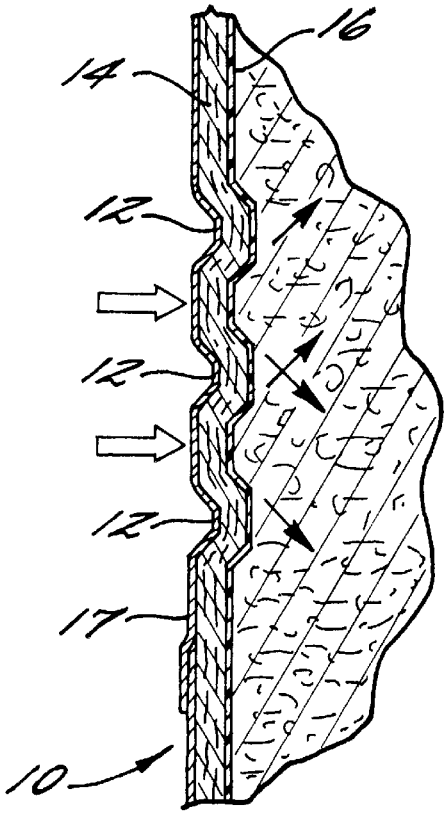
FIG. 2 is an enlarged cross-sectional view through the container of FIG. 1 and taken generally along the line 2—2 of FIG. 1.
Figure 3:
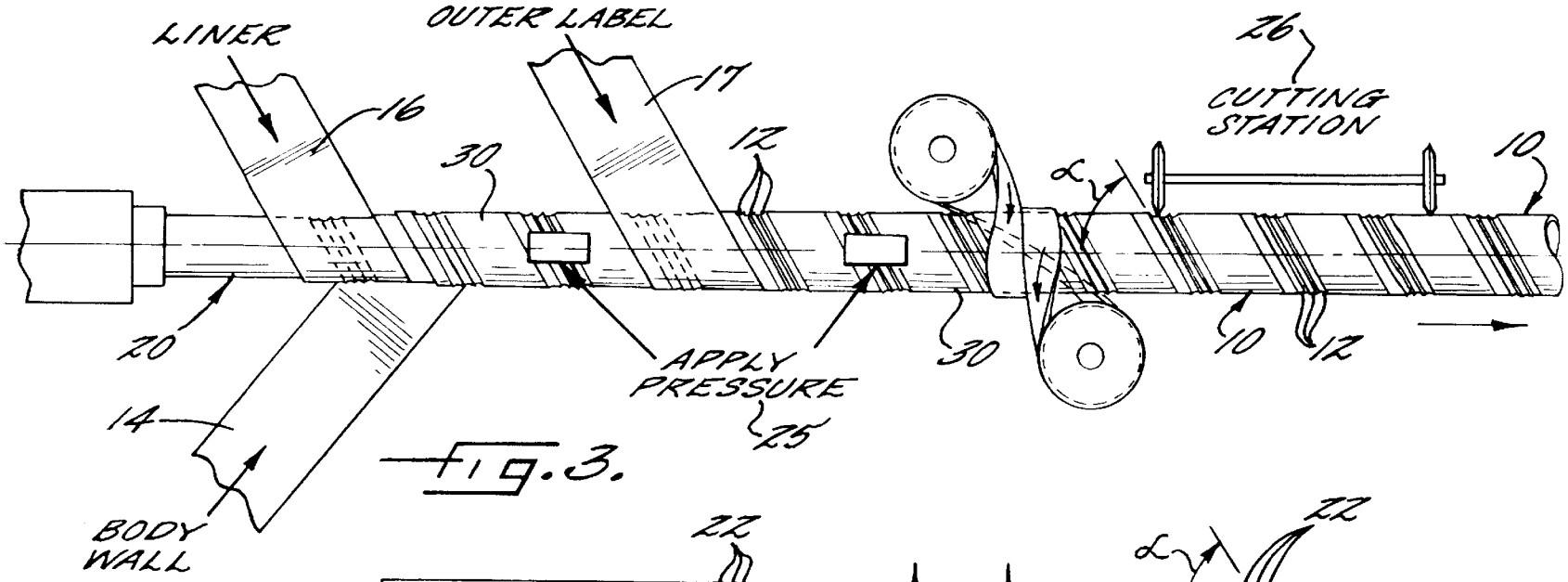
FIG. 3 is a somewhat diagrammatic plan view illustrating the process for manufacturing a cylindrical composite container having a recessed spiral groove therein in accordance with this invention.
Figure 4:
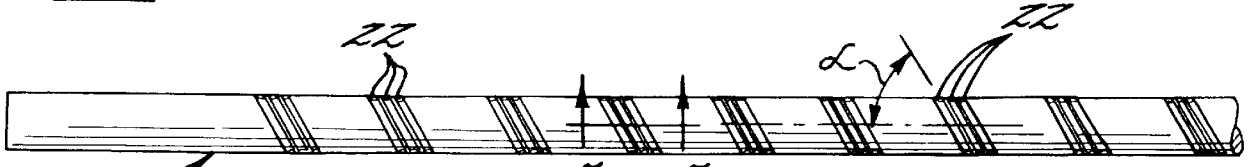
FIG. 4 is a plan view of a mandrel utilized in the process illustrated in FIG. 3 and having a plurality of closely-spaced spiral grooves positioned therein at a predetermined angle resulting in a spaced group of spiral grooves around the mandrel.
Figure 5:
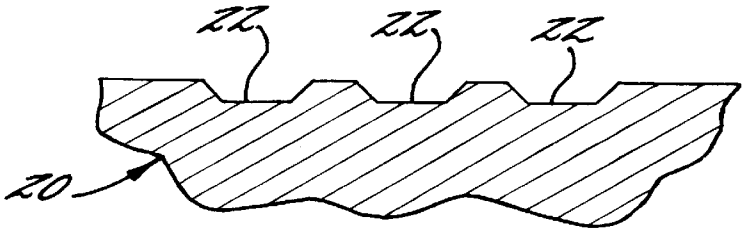
FIG. 5 is an enlarged sectional view through such spaced group of spiral grooves in the mandrel of FIG. 4 and taken generally along the line 5—5 of FIG. 4.

FIGS. 1 and 2 illustrate a cylindrical composite container, generally indicated at 10, having recessed spiral grooves 12 therein and FIGS. 3–5 illustrate a process and related apparatus which may be utilized for manufacturing such composite container 10.

As shown in FIGS. 1 and 2, the composite container 10 is constructed of at least one spirally-wound paperboard bodywall layer 14 in strip form defining a substantially cylindrical container having opposed ends. These opposed ends may be closed with any suitable closures 15. Suitable closures 15 are well understood by those with ordinary skill in the art and need not be further explained herein for an understanding of the present invention. The composite container 10 further includes a liner layer 16 in strip form spirally-wound inside the bodywall layer in superimposed position therewith. If desired, the container may further include a label layer 17 in strip form spirally-wound outside the bodywall layer 14 in superimposed position therewith.

In accordance with this invention, at least one recessed spiral groove 12 is formed in the bodywall layer 14, liner layer 16 and label layer 17 (when provided) and extends around the cylindrical container 10 along its entire length. The spiral groove 12 is positioned at an angle a to a longitudinal axis of the container (as shown in FIG. 1) which corresponds to a winding angle of the spirally-wound container (as shown in FIGS. 3 and 4). Preferably, the at least one recessed spiral groove 12 comprises a plurality of closely-spaced spiral grooves 12 positioned at an angle to the longitudinal axis for forming a spaced group of spiral grooves 12 around the cylindrical container along its length (as shown particularly in FIG. 1).

The bodywall layer 14 may be advantageously composed of conventional spiral-winding paperboard or board stock having a thickness of between 0.010 and about 0.035 inch, preferably between about 0.015 and 0.030 inch, for example 0.021 inch. The board stock conventionally used in the manufacture of spirally-wound composite containers is commercially available from various manufacturers including Sonoco Products Company, Republic Paperboard Corporation and Middletown Board Corporation. In order to function advantageously as the spirally-wound bodywall layer, the board stock typically is composed of Kraft or recycled paper and can typically range from, e.g. 50 to 100 lbs./ream. In some instances, the board stock can include a weak exterior layer, e.g. a 0.003 inch exterior news. The liner layer 16 may advantageously be a barrier type, flexible sheet material, such as a polymer/foil, a Kraft/foil/polymer, a polymer/polymer, or a Kraft/foil laminate. The label layer 17 is conventionally constructed from suitable materials, such as Kraft paper, a polymer, a polymer/polymer laminate, a polymer/foil laminate, a Kraft paper foil laminate or the like. Suitable adhesives, well known to those with ordinary skill in the art, may be placed between these layers.

As discussed above, the geometry of the recessed grooves provides a spirally-wound container 10 having greater resistance to rupture and better cushioning from a side impact. The inwardly extending grooves 12 (as shown in FIG. 2) provide slightly more material in the container 10 than would a straight walled container due to the hemispherical shape of the grooves 12. This extra material in the grooves 12 can flex upon receiving an impact due to its geometrical shape without rupturing as would happen with straight walled container that cannot flex. Kinetic energy, as indicated by the large arrows in FIG. 2, transferred to the container 10 from a side impact is dissipated, as indicated by the small arrows in FIG. 2, much more rapidly due to the presence of the recessed grooves 12. This kinetic energy is absorbed by the flexing of the recessed hemispherical grooves and thus prevents the energy from transferring directly to the product packaged within the container 10.

Referring now to FIGS. 3–5, there is illustrated therein a process for manufacturing the above described cylindrical composite container 10 having at least one recessed groove 12 therein. As may be seen, a mandrel 20 is provided. Such mandrels in composite container spirally-winding equipment are well understood by those of ordinary skill in the art and will not be described in detail herein. This mandrel 20 (see particularly FIGS. 4 and 5) includes at least one recessed spiral groove 22 positioned at a predetermined angle a to a longitudinal axis of the mandrel 20. Preferably, there are provided a plurality of closely-spaced recessed spiral grooves 22 positioned at a predetermined angle resulting in a spaced group of spiral grooves around the mandrel. The bodywall layer 14, liner layer 16 and label layer 17 (if utilized) are fed onto the mandrel 20 (see FIG. 3) while spirally-winding these material layers at a winding angle $\alpha$ corresponding to the predetermined angle $\alpha$ of the spiral grooves 22 in the mandrel 20 while the mandrel 20 is rotating to form a continuous tube 30 on the mandrel 20.

External pressure is applied by any suitable device, indicated diagrammatically at 25, at the mandrel spiral grooves 22 to the continuous tube 30 as it is being formed to force the material layers 14, 16 and 1 7 (if utilized) into the spiral grooves 22 for deforming the material layers 14, 16, 17 to form spiral grooves 12 in the continuous tube 30. Thereafter, the continuous tube 30 with spiral grooves 12 therein is cut into individual container lengths 10 by any suitable cutting mechanism, diagrammatically indicated at 26. These container lengths 10 are then removed from the mandrel 20. One or both of the ends 15 may be applied to these cylindrical container lengths before, during or after the product filling operation to complete the container 10.

Thus, this invention has provided a novel and improved cylindrical composite container 10 having at least one recessed spiral groove 12 therein which is aesthetically different from current composite container constructions, provides greater resistance to rupture and better cushioning from side impact of a filled container and is ergonomically improved in that it is easier to handle and hold than composite containers without a recessed groove therein. This invention has also provided a practical process for manufacturing such composite container 10 having a recessed spiral groove 12 therein during spiral-winding of the material layers 14, 16 and 17 (if desired) on a mandrel 20 in a spiral-winding machine.

The invention has been described in considerable detail with reference to this preferred embodiment of the container 10 and its process of manufacturing. However, variations and modifications can be made to both the product and process within the spirit and scope of the invention as described in the foregoing specification and as defined in the following claims.

What is claimed is:

1. Process for manufacturing a cylindrical composite container having a recessed spiral groove therein and comprising the steps of:

providing a mandrel having at least one recessed spiral groove cut into its surface and positioned at a predetermined angle to a longitudinal axis of the mandrel;

providing desired material layers for constructing the composite container;

feeding the material layers onto the mandrel while spirally-winding the material layers at a winding angle corresponding to the predetermined angle of the spiral groove in the mandrel to form a continuous tube on the mandrel;

applying external pressure at the mandrel spiral groove to the continuous tube as it is being formed to force the material layers into the spiral groove for deforming the material layers to form a spiral groove in the continuous tube;

cutting the continuous tube with spiral groove therein into individual container lengths; and removing the container lengths from the mandrel.

2. Process, as set forth in claim 1, in which said step of providing a mandrel further includes providing such mandrel with a plurality of closely-spaced spiral grooves positioned at a predetermined angle resulting in a spaced group of spiral grooves around the mandrel and thus around the manufactured composite container.

3. Process, as set forth in claim 1 or 2, in which said step of providing desired material layers for constructing the composite container further comprises providing a liner layer and at least one paperboard bodywall layer.

4. Process, as set forth in claim 3, in which said step of providing desired material layers for constructing the composite container further comprises providing a label layer.

5. A cylindrical composite container produced in accordance with the process of claim 1 or 2.

6. A cylindrical composite container produced in accordance with the process of claim 3.

7. A cylindrical composite container produced in accordance with the process of claim 4.

* * * * *